US007350625B2

(12) United States Patent
Deplazes et al.

(10) Patent No.: US 7,350,625 B2
(45) Date of Patent: Apr. 1, 2008

(54) SHAFT DOOR MONITORING SYSTEM FOR AN ELEVATOR INSTALLATION

(75) Inventors: Romeo Deplazes, Oberruti (CH); Philipp Angst, Zug (CH)

(73) Assignee: Inventio AG, Hergiswil NW (CH)

( * ) Notice: Subject to any disclaimer, the term of this patent is extended or adjusted under 35 U.S.C. 154(b) by 551 days.

(21) Appl. No.: 10/947,772

(22) Filed: Sep. 23, 2004

(65) Prior Publication Data

US 2005/0034931 A1 Feb. 17, 2005

(51) Int. Cl.
*B66B 1/34* (2006.01)

(52) U.S. Cl. ..... 187/393; 187/314

(58) Field of Classification Search ..... 187/247, 187/248, 391–394, 390, 413, 414, 316, 317, 187/314

See application file for complete search history.

(56) References Cited

U.S. PATENT DOCUMENTS

| | | | | |
|---|---|---|---|---|
| 3,054,475 | A * | 9/1962 | Moser et al. | 187/280 |
| 5,476,157 | A * | 12/1995 | Todaro | 187/280 |
| 5,616,895 | A * | 4/1997 | Spiess | 187/280 |
| 6,382,362 | B1 * | 5/2002 | Kutz | 187/316 |
| 6,443,265 | B1 * | 9/2002 | Nakamori et al. | 187/317 |
| 6,732,839 | B2 * | 5/2004 | Schuster | 187/391 |
| 6,945,363 | B2 * | 9/2005 | Angst et al. | 187/317 |
| 7,077,244 | B2 * | 7/2006 | Oh et al. | 187/394 |
| 2005/0098390 | A1 * | 5/2005 | Angst | 187/391 |
| 2006/0175135 | A1 * | 8/2006 | Meissner et al. | 187/249 |

FOREIGN PATENT DOCUMENTS

| | | |
|---|---|---|
| DE | 199 63 038 | 7/2001 |
| FR | 2 814 162 | 3/2002 |
| GB | 1 457 617 | 12/1976 |
| WO | WO 02/12109 | 2/2002 |
| WO | WO 03/024856 | 3/2003 |

* cited by examiner

*Primary Examiner*—Jonathan Salata
(74) *Attorney, Agent, or Firm*—Fraser Clemens Martin & Miller LLC; William J. Clemens

(57) ABSTRACT

A shaft monitoring system for an elevator installation includes a contactless sensor enabling recognition from the elevator car whether a shaft door lock and a shaft door leaf are in a correct locked setting. A securing device mechanically secures the shaft door lock in order to prevent opening of the shaft door and is mechanically and/or electromagnetically actuatable from the elevator car. The contactless sensor includes an active sensor part arranged at the car door and a passive sensor part arranged at the shaft door lock to be monitored. The active sensor part interacts with the passive sensor part as soon as the elevator car stops behind the shaft door and the shaft door leaf and the shaft door lock are disposed in the correct locked setting. The active sensor part also can transiently interact with the passive sensor part when the elevator car moves past the shaft door.

14 Claims, 4 Drawing Sheets

SHAFT DOOR MONITORING SYSTEM FOR AN ELEVATOR INSTALLATION

BACKGROUND OF THE INVENTION

The present invention relates to monitoring of the shaft doors of an elevator system.

Elevator systems of the conventional kind generally comprise shaft doors by which the elevator shaft can be separated from the adjoining areas in each floor. Many elevator systems additionally have car doors by which the elevator car is self-closing and which move together with the car from floor to floor. For reasons of safety all shaft doors must always be closed in operation with the exception of the shaft door of that floor in which the elevator car has just stopped. Equally, the car doors have to be closed when the elevator has not just stopped at a floor in order to allow loading or unloading or entering or leaving. For maintenance purposes the shaft and/or car doors can obviously also be opened when the elevator car is disposed elsewhere than in the above-described positions. The state, i.e. the setting of the shaft doors or the setting of locks by which the shaft door leaf or leaves is or are lockable in the closed setting thereof, is monitored with the help of monitoring systems. For this purpose sensor means, for example in the form of positively guided devices with safety contact positions, are provided. The safety contact positions are integrated in series connection in a safety circuit. The arrangement is realized in such a manner that the elevator car can be moved only when the safety circuit and thus also all safety contacts integrated therein are closed.

Monitoring systems with safety circuits of this kind are subject to numerous disadvantages which are briefly listed in the following:

Each safety circuit has inherent problems; belonging thereto are the length of the connections, the voltage drop in the safety circuit and the comparatively high assembly cost.

Individual safety contacts are relatively susceptible to fault; unnecessary emergency stops of the elevator system therefore frequently occur.

Notwithstanding a monitoring system with a safety circuit, unsafe and risky situations cannot be entirely avoided; on the one hand the safety contacts can individually or in common be bridged over relatively easily, which is virtually equivalent to placing the safety precautions out of action, and on the other hand an open shaft door does indeed prevent movement of the car, but if the car is not located at the shaft door just open the risk nevertheless exists of a fall through the open shaft door.

Intelligent or situationally appropriate reactions, for example in the case of interruption of the safety circuit, are not possible; in particular, it is not possible to avoid unintentional trapping of persons in the elevator car.

The monitoring system does not allow a specific diagnosis, i.e. if the safety circuit is opened it can only be established that at least one safety contact and thus at least one lock or at least one shaft door is open. However, it cannot be established which safety contact has opened. The monitoring system does not, before a fault in the safety circuit occurs, deliver any information allowing recognition of the state (wear, corrosion) of individual safety contacts or enable identification thereof. A state-dependent maintenance at an instant in time in which the elevator car can be shut down without problems is thus not assisted.

Serviceability of the elevator is limited, since an open safety contact always has the consequence of placing the elevator system out of operation even when another solution, for example blocking of the access region to a non-closable shaft door, would be possible.

A further disadvantage of known systems is that each shaft door leaf is provided with at least one electrical contact which has to be incorporated into the safety circuit. This approach is laborious and costly.

An improved system in which the state of the shaft doors is detected by way of a bus at the floor side and by way of a car bus is described in a European patent application with the title "Elevator system". This application was filed on Sep. 18, 2001 and carries the application number 01810903.3. In the case of the monitoring system for an elevator described in this patent application the shaft doors and/or the car doors have sensor means by which the state thereof, i.e. the position of its door leaves, is detected. The monitoring system additionally comprises an evaluating system which is connected with the sensor means and which evaluates the signals delivered by the sensor means. This evaluation is carried out at short intervals in time and makes it possible to detect the state of the monitored shaft or car door leaf; equally, changes in the signal characteristic over time can be detected. According to this improved system, detection of the state of the shaft or car door leaf by the sensor means can be analyzed and is capable of diagnosis. Moreover, a gradual deterioration of individual subsystems is recognizable so that preventative maintenance can be initiated in good time.

SUMMARY OF THE INVENTION

The present invention concerns a shaft monitoring system for an elevator installation having an elevator car with a car door and being vertically movable in an elevator shaft, a shaft door by which access to the elevator shaft is closable and which has a door leaf, an automatically locking shaft door lock for locking the door leaf of the shaft door when the door leaf is in a closed setting, wherein the shaft door leaf can be unlocked by the elevator car, and an elevator control. The system includes a contactless sensor means enabling recognition from the elevator car whether the shaft door lock and the door leaf of the shaft door are disposed in a correct locked setting thereof, the sensor means being connected with at least one of the elevator control and a separate safety monitoring system of the elevator installation. The system further includes a shaft door lock securing means for mechanically securing the shaft door lock in order to prevent opening of the shaft door, the shaft door lock securing means being one of mechanically and electromagnetically actuatable from the elevator car.

The contactless sensor means includes an active sensor part and a passive sensor part, the active sensor part being arranged at the elevator car, and the passive sensor part being arranged in the region of the shaft door lock to be monitored. Preferably, the active sensor part is arranged at the car door. The active sensor part interacts with the passive sensor part as soon as the elevator car stops behind the shaft door to be monitored and the door leaf of the shaft door together with the shaft door lock to be monitored are disposed in the correct locked setting thereof. The active sensor part also can transiently interact with the passive sensor part when the elevator car moves past the shaft door to be monitored and the door leaf of the shaft door together with the shaft door lock to be monitored are disposed in the correct locked setting thereof.

An object of the present invention is an improved monitoring for elevator shaft doors by which the disadvantages of the state of the art can be avoided or at least significantly reduced.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
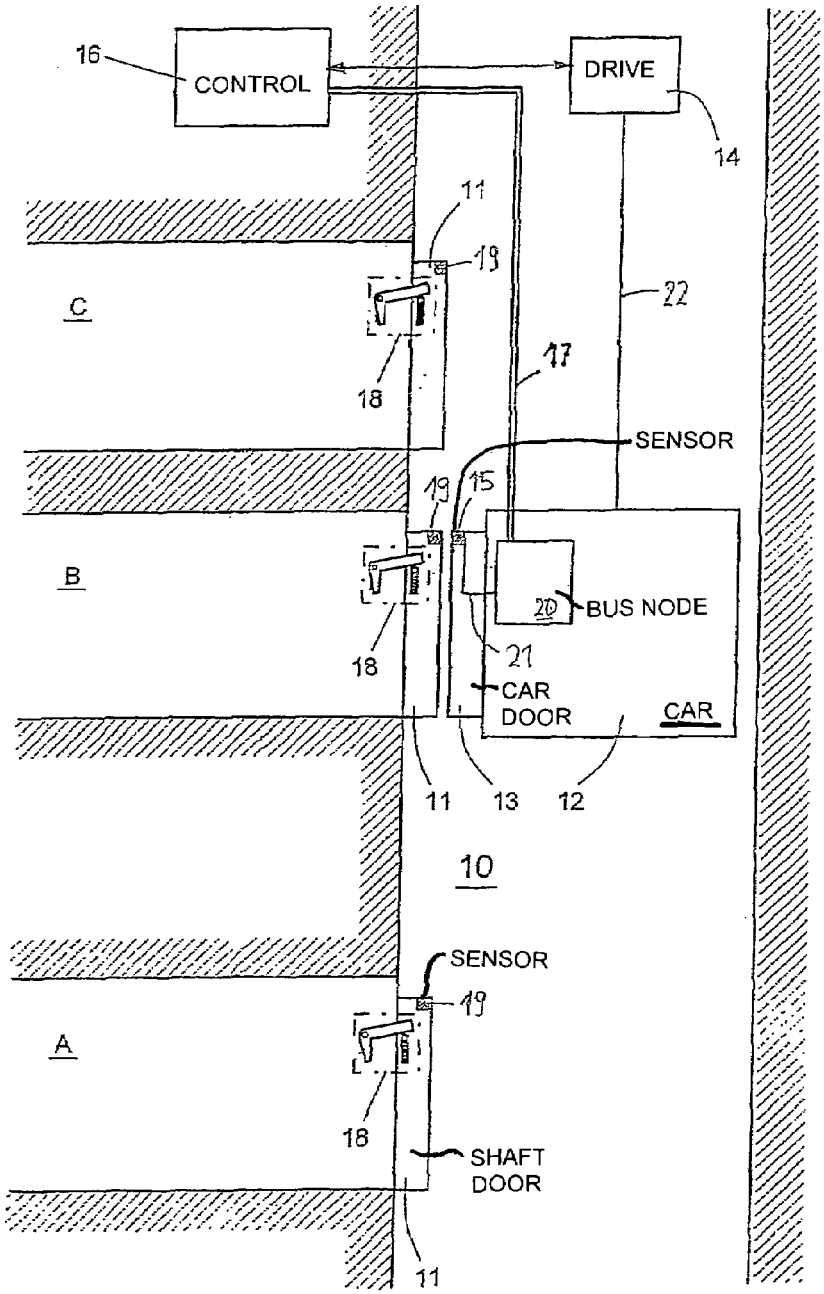
FIG. 1 shows an elevator system with a first monitoring system according to the present invention, in simplified schematic illustration.

FIG. 1 shows a first form of embodiment of the present invention. There is shown an elevator system comprising an elevator car 12 which is guided to be vertically movable in an elevator shaft 10. The elevator car 12 can serve three floors A, B and C. The elevator car 12 is closed by a car door 13. Each of the three floors has a shaft door 11. As soon as the elevator car 12 travels behind a floor door in order to stop at the corresponding floor the shaft door 11 of this floor is opened by the car door 13. In the illustrated case the car 12 is disposed at the level of the floor B. The corresponding shaft door 11 and the car door 13 are opened, which cannot be seen in FIG. 1. The shaft door 11 is provided with a self-closing device so that the leaves of the shaft door 11 automatically shut if they are not actively held open.

Shaft and car doors can comprise one or more door leaves. In the following the present invention is respectively described only with respect to doors with one door leaf. It is emphasized at this point that the features, functions and characteristics according to the invention also apply to multi-leaf doors.

An automatically locking shaft door lock 18 is provided which locks the leaf of the shaft door 11 as soon as this has reached its closed setting, wherein the shaft door lock 18 can be unlocked by the elevator car 12.

As schematically illustrated in FIG. 1 there is provided a control 16 which is connected with a drive 14 and moves the elevator car 12 by way of a cable 22. The elevator car 12 is disposed in communicating connection with the elevator control 16 by way of a car bus 17. The car bus 17 is preferably a safety bus. According to the invention the elevator installation is equipped with contactless sensor means 15, 19. These sensor means 15, 19 serve the purpose of monitoring, from the elevator car 12, whether locking of the shaft door lock 18 has taken place. Beyond that, depending on the respective form of embodiment the sensor means 15, 19 can also serve for repeated monitoring of the locked state of the shaft door lock 18, wherein this monitoring is undertaken while the elevator car 12 moves past the shaft doors. In order to enable monitoring from the elevator car the sensor means 15, 19 are connectable with the elevator control 16 by way of the car bus 17. Alternatively, the sensor means 15 can be connected with the elevator control 16 by a safety monitoring system. Such a safety monitoring system can serve the purpose of detecting at least a part of the safety-relevant states of an elevator installation separately from the actual elevator control and, in the case of occurrence of problems, triggering reactions intervening directly in the elevator control.

The mode of operation of the above-described form of embodiment is as follows:

Before the elevator car 12 leaves a floor (for example, floor B), the car 13 and therewith also the leaf of the shaft door 11 of this floor are closed. As soon as the leaf of the shaft door 11 has reached its closed setting, the shaft door lock 18 drops into the locked state, whereby the shaft door is secure against unauthorized or inadvertent opening. The contactless sensor means 15, 19 notify the elevator control 16 by way of the bus 17 that the shaft door lock 18 was closed and is now closed. Only after the shaft door lock 18 has been reported as closed does the elevator control 16 set the elevator car 12 in motion by way of the drive 14. As long as this report is absent, the elevator car 12 remains at standstill.

While the elevator car 12 moves in the shaft 10, the sensor means 15, 19 can, with each movement past a shaft, detect the locked state of the shaft door lock 18 thereat. This state information can be transmitted to the control 16. Should one of the shaft door locks 18 not be locked, then a corresponding reaction (for example, shutting-down the elevator or an emergency call) can be triggered.

Figure 2:
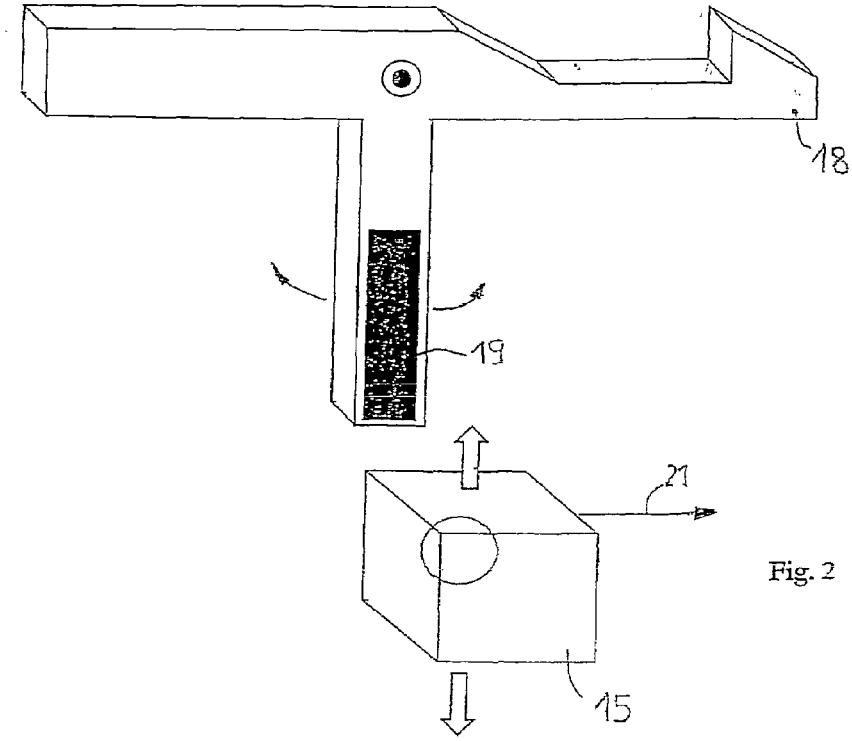
FIG. 2 shows a detail perspective view of a shaft door lock with sensor means, according to the present invention.

A further form of embodiment of the present invention is distinguished by the fact that the contactless sensor means comprise an active sensor part 15 and a passive sensor part 19, as shown on the basis of an example in FIG. 2. The active sensor part 15 is arranged at the elevator car 12, for example at the car door, and the passive sensor part 19 is arranged in the region of the shaft door lock 18 to be monitored. As shown in FIG. 2, the passive sensor part can be seated directly on the shaft door lock 18 to be monitored.

The arrangement of the active and the passive sensor part is preferably undertaken in such a manner that the active sensor part 15 can come into interaction with the passive sensor part 19 as soon as the elevator car 12 stops behind the shaft door 11 to be monitored and the shaft door 11 together with the shaft door lock 18 to be monitored are closed. In FIG. 2 there is shown a state in which the shaft door lock 18 is closed and the elevator car 12 inclusive of the active sensor part 15 approaches the stopping position.

As indicated in FIG. 1, the car 12 can be equipped with a bus node 20. All elements of the car 12 which act on the bus 17 or have to be reachable by the bus can be connected with the bus 17 by way of the bus node 20. In the illustrated form of embodiment the active sensor part 15 is, for example, connectable with the bus node 20 by way of a cable 21 or another form of connection.

In another form of embodiment (not shown) the sensor means is connected by way of direct (parallel) wiring with the elevator control. In this case a car bus is not needed in order to produce a connection between the sensor means and the elevator control.

In a further preferred form of embodiment the two sensor parts 15 and 19 are so designed and mounted that they can transiently interact each time the elevator car 12 moves past a shaft door 11 to be monitored and the shaft door 11 together with the shaft door lock 18 to be monitored are closed. It can thereby be checked every time the car 12 travels past whether the car door lock 18 is closed.

The shaft door lock 18 can, for example, be so mounted at the leaf of the shaft door 11 that it is lockable by a part which is fixedly connected with a door frame fastened to the elevator shaft 10. For this purpose the shaft door lock 18 has a rotational axle and an arm which is constructed to be hook-shaped and which engages in a recess of the part connected with the shaft door frame. Moreover, the shaft door lock 18 is provided with a weight or a spring so that the lock 18 automatically locks the leaf of the shaft door 11 as soon as this has reached its closed setting.

Figure 3:
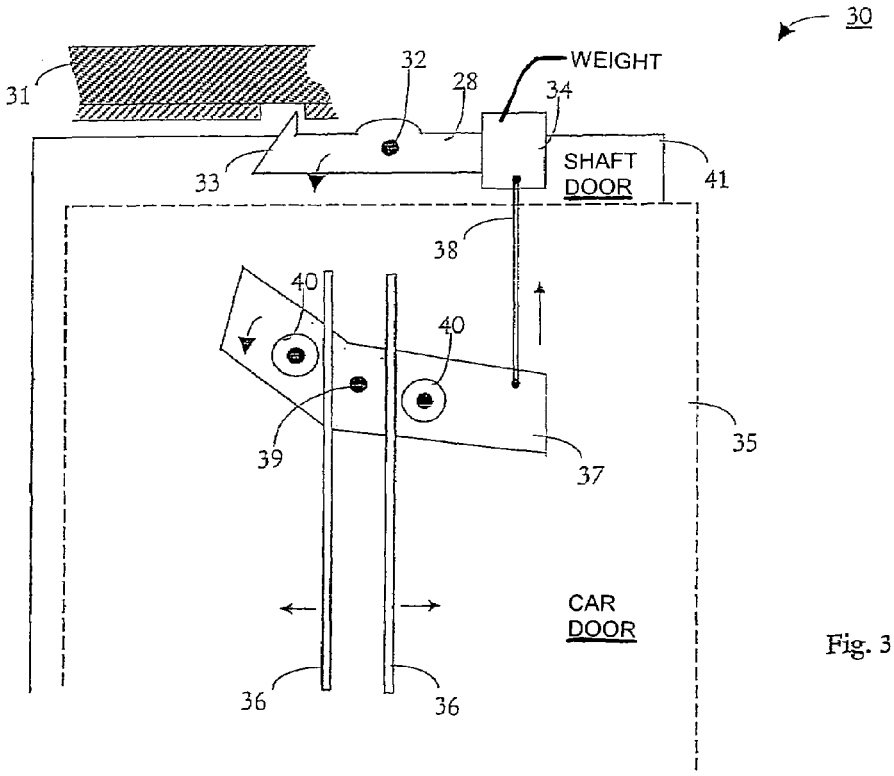
FIG. 3 shows a detail schematic view of a shaft door lock with reversing means, according to the present invention.

A locking mechanism 30 according to the present invention is illustrated in FIG. 3. The form of illustration is so selected that the locking mechanism 30 is seen from the elevator car through a car door 35 (illustrated in dashed lines). In the upper region of FIG. 3 a shaft door lock 28 can be seen in closed state (i.e. in locked state). The shaft door lock 28 engages by an arm 33 of hook-shaped construction in a recess of a shaft door frame 31 and locks a shaft door 41 against unintended or unauthorized opening. The lock 28 is so arranged that it can rotate about an axle 32 as indicated by an arrow. The shaft door lock 28 is provided with a weight 34 so that the lock 28 hooks in by itself as soon as the leaf of the shaft door 41 has reached its closed setting.

If the elevator car now approaches, by its car door 35, a floor then two entraining blades 36 of a door entraining mechanism mounted at the leaf of the car door 35 engage in a deflecting mechanism 37 which is mounted at the leaf of the shaft door 41 and which is mechanically connected with the shaft door lock 28 by way of a rod 38. In the case of the illustrated form of embodiment of the locking mechanism 30 the entraining blades 36 are spread apart before the beginning of the door opening movement. A force is exerted on rollers 40 of the deflecting mechanism 37 by this movement apart of the entraining blades 36, whereby the deflecting mechanism 37 executes a slight rotational movement in a counterclockwise sense about the rotational axle 39 as indicated by an arrow. The rod 38 thereby urges the weight 34 of the lock 28 upwardly and locking of the leaf of the shaft door 41 relative to the shaft door frame 31 is released. The shaft door 41 can now be opened by the car door 35.

In the case of conjunctive closing of car and shaft door the entraining blades 36 move towards one another again at the end of the closing process so that the aforedescribed unlocking action is cancelled and the arm 33 of hook-shaped construction of the lock 28 detents in the recess connected with the shaft door frame 31, whereby the leaf of the shaft door 41 is locked.

The deflecting mechanism 37 is preferably provided with the rollers 40 so as to enable movement of the entraining blades 36 with reduced friction. Whilst the elevator car moves in the elevator shaft, the entraining blades 36 are held (for example by a spring) at a minimum mutual spacing so that the elevator car can move from floor to floor without the entraining struts 36 colliding with the rollers 40 of the deflecting mechanism 37 mounted at the shaft doors 41. The entraining blades 36 are spread apart only when the elevator car approaches a floor and the door opening process begins. The door opening process can be already commenced while the elevator car slowly approaches the stopping position, since the entraining blades 36 have an appropriate length. As soon as the leading ends of the two entraining blades 36 are disposed between the rollers 40 the spreading movement can begin.

Figure 4:
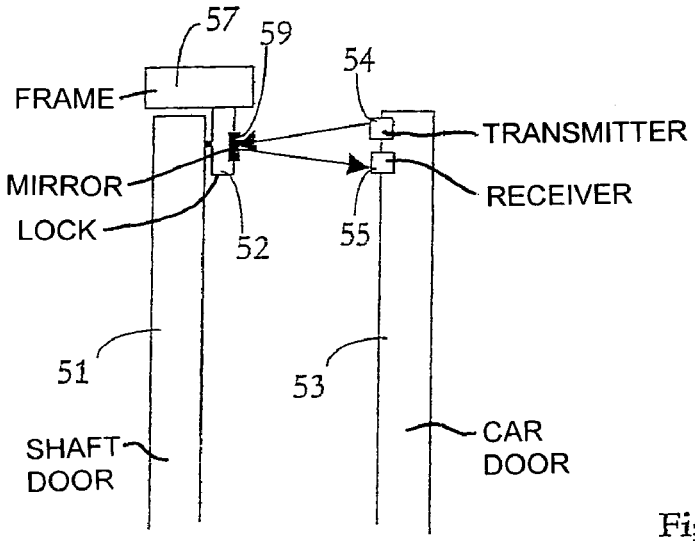
FIG. 4 shows a detail schematic view of a shaft door lock with sensor means, according to the present invention.

Several possibilities for realization of the contactless sensor means are described in the following by way of example. An appropriate sensor means is schematically illustrated in FIG. 2. A sensor means which operates optically is shown in FIG. 4. Seated at the upper end of the leaf of a shaft door 51 is a shaft door lock 52 which engages in a recess of a shaft door frame 57 and locks the leaf of the shaft door 51. An elevator car (not shown) is disposed at the same height as the shaft door 51. The elevator car carries a car door 53 with a door leaf, at the upper end of which an active sensor means 54, 55 is provided. It comprises a transmitter 54 which transmits a light beam in the direction of the shaft door lock 52. A passive sensor part 59, which reflects the light beam and guides it back in the direction of the active sensor means, is disposed at the shaft door lock 52. There the light beam is received by a receiver 55 and converted into an electrical signal which can be transmitted for evaluation either to a local evaluating device or by way of a bus or parallel wiring to a remote evaluating device. If the shaft door lock 52 is disposed in the desired position then the light beam is reflected for the greatest part and detected on the receiving side. If the shaft door lock 52 is opened (not locked) the passive sensor part 59 is not disposed in the region of the transmitted light beam and no light, or only a small proportion of the light, is reflected to the receiver. It is thus recognizable whether the shaft door lock 52 is closed. If the sensor means based on an optical principle operates sufficiently rapidly it can also be ascertained from the elevator car when travelling past whether the shaft door lock 52 is locked. A mirror, a reflective surface or a reflector can be used as the passive sensor means 59.

A further sensor means operating contactlessly and based on the radio frequency identification principle (RFID) can be realized as follows. An RFID tag (for example, in the form of a thin adhesive label) can be fixed to the shaft door lock. An active sensor part, which essentially comprises a transmitter and receiver, is disposed at the elevator car. The transmitter emits an electromagnetic field. If the active part and the passive part are disposed in a specific predefined setting relative to one another then the electromagnetic field interacts with the RFID tag. In that case the RFID tag receives electromagnetic energy and transmits back an identification signal. A unique identification can be assigned to each of the shaft doors. The contactlessly operating sensor means can thus recognize whether an identification signal is received, from which it can be concluded that the shaft door lock is closed, since only in this case does the interaction between transmitter, RFID tag and receiver come into being. Moreover, the respective shaft door can be uniquely recognized by way of the identification. If, for example, problems with the shaft door lock should result in the case of one of the shaft doors, then the shaft door concerned can be identified and thereby ensure that a service engineer can more quickly localize the location subject to a problem. This is of significance particularly in the case of large buildings with numerous floors. Thus, in FIG. 4, the sensor part 59 can be the RFID tag, the sensor part 54 and be the RFID transmitter and the sensor part 55 can be the RFID receiver.

A further form of embodiment is distinguished by the fact that a magnetic element as passive sensor part is provided in the region of the shaft door lock to be monitored. A magnetic sensor, which serves as active sensor part, is disposed at the elevator car or preferably at the car door. The arrangement and sensitivity have to be so selected that the magnetic field emanating from the magnetic element is detectable by the magnetic sensor when the elevator car is disposed in the region behind the shaft door and the shaft door lock is locked. Thus, in FIG. 4, the sensor part 59 can be the magnetic element and the sensor parts 54 and 55 can be the magnetic sensor.

As alternatives, sensor means based on ultrasound or radio frequency can also be used. It is also possible to use inductively or capacitively operating sensor means. In the case of a capacitively operating sensor means the arrangement can be so selected that in the presence of the locked shaft door lock a disturbance of an electromagnetic field results in the vicinity of the active sensor part. Such a disturbance can be made detectable by, for example, tuning of an oscillator circuit.

In order to achieve additional safety, there can be used, instead of only one contactlessly operating sensor means per shaft door lock, also a second contactlessly operating sensor means.

A further form of embodiment of the invention is distinguished by the fact that there is provided a shaft door lock securing means which serves the purpose of mechanically locking the shaft door lock in order to prevent unintended opening of the shaft door lock and thus of the shaft door. The shaft door lock securing means is constructed so that it can be activated from the elevator car. The lock setting of the shaft door lock can be secured by, for example, a suitable pin in such a manner that the shaft door lock cannot be unlocked as long as this pin is in a securing position. A permanent monitoring of the shaft doors is thus no longer necessary if it is possible to rely on the fact that the shaft door has been securely closed, locked and secured by the shaft door lock securing means.

Figure 5:
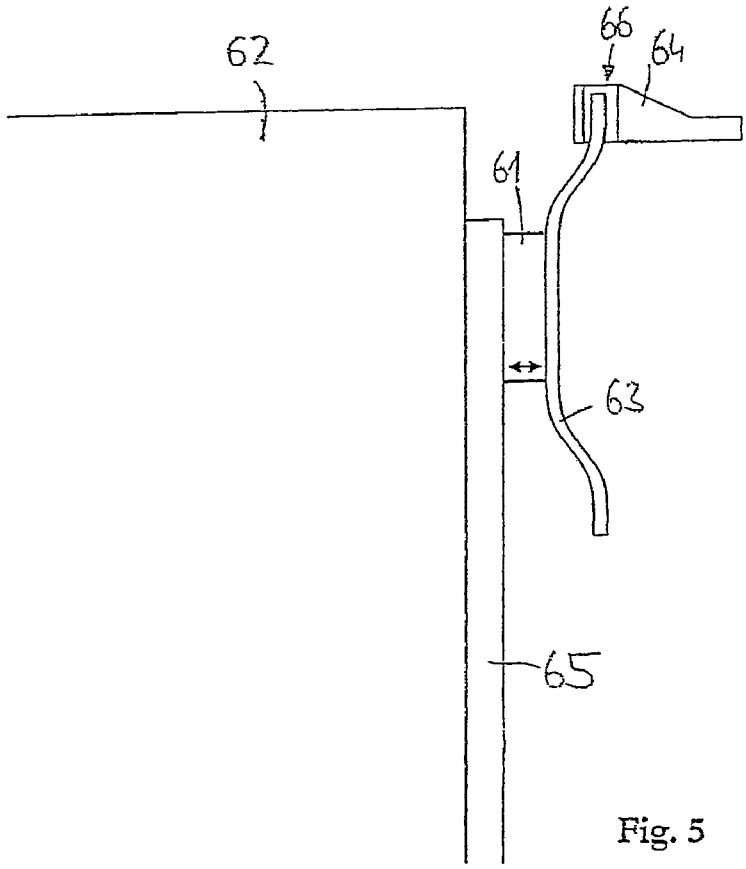
FIG. 5 shows a detail schematic view of a mechanical system for securing and releasing a shaft door lock securing means, according to the present invention.

In a first form of embodiment the shaft door lock securing means is mechanically unlocked from the elevator car when the elevator car approaches a floor at which the elevator car stops. An example for mechanical unlocking of the shaft door lock securing means is shown in FIG. 5. An elevator car 62 carries a car door 65 to which an unlocking cam 63 is fastened. This unlocking cam is seated on a fastening means 61 which is so constructed that the unlocking cam 63 during normal travel of the elevator car 62 can be retracted. This is necessary so as to prevent the unlocking cam from colliding with a shaft door lock securing means 64 during travel past a shaft door. When the elevator car 62 approaches a destination floor then the unlocking cam 63 is moved out by enlarging the spacing from the car door 65. As shown in FIG. 5, the shaft door lock securing means 64 has a recess 66. The profile of the unlocking cam 63 is so selected that the upper free end of the unlocking cam 63 engages in the recess 66 of the shaft door lock securing means 64 (this initial state is shown in FIG. 5) while the car 62 executes a small upward movement (if the car 62 approaches the floor from below) in order to then come to rest at the level of the floor. While the elevator car 62 covers the last few centimeters of travel the shaft door lock securing means 64 slides along the unlocking cam 63 and follows the profile thereof. A movement of the shaft door lock securing means 64 away from the shaft door towards the car door 65 thereby results. This movement is sufficient to unlock the shaft door lock, which is not shown in FIG. 5. As soon as the shaft door lock securing means 64 is unlocked, the shaft door lock can be unlocked by spreading of the entraining blades and the shaft door opened. If the elevator car 62 leaves the floor after the leaf of the shaft door has reached its closed setting and the shaft door lock is in locking setting, then the shaft door lock securing means 64 is pushed by the unlocking cam 63 back in direction of the shaft door in order to there secure shaft door lock.

Numerous other forms of embodiment are conceivable which are suitable for the purpose of activating and deactivating the shaft door lock securing means 64.

In a further form of embodiment the shaft door lock securing means is unlocked in contactless manner. In this case the shaft door lock securing means can, for example, be unlocked by way of a magnetic field able to be switched on and off. Generation of the magnetic field, for example by a coil on a soft-iron core, takes place from the elevator car.

Figure 6:
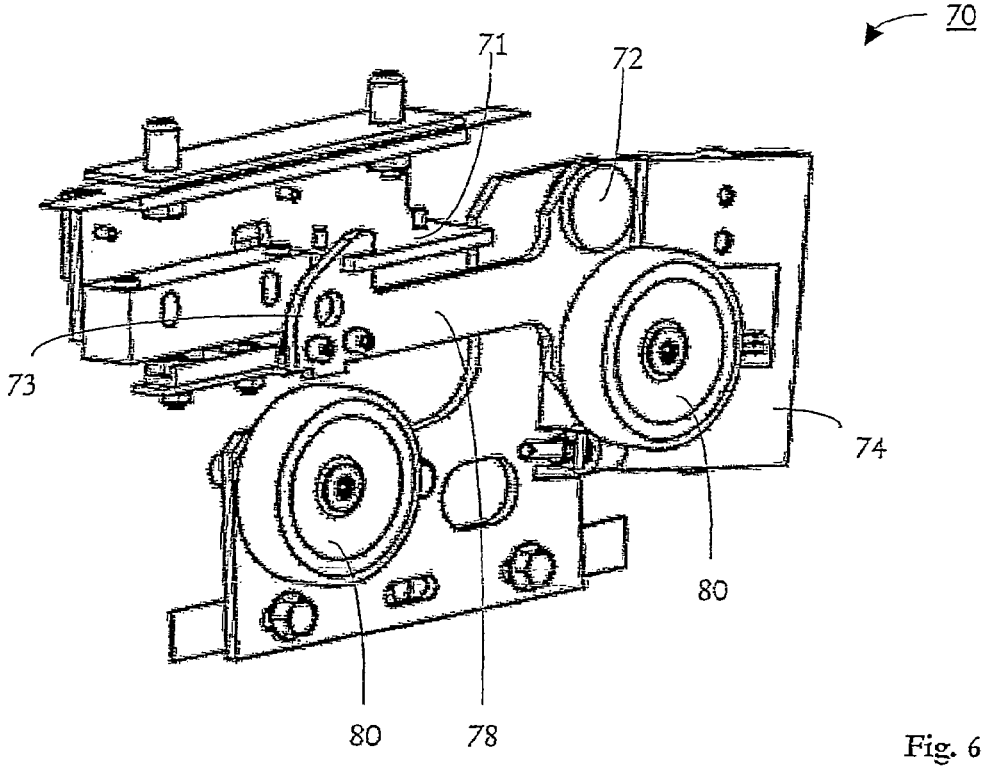
FIG. 6 shows a detail perspective view of a further embodiment shaft door lock with deflecting means, according to the present invention.

A further shaft door locking mechanism 70 according to the invention is shown in FIG. 6. A shaft door lock 78 in closed state (i.e. in locked state) can be seen. The shaft door lock 78 engages by an arm 73 of hook-shaped construction in a lock member 71 and locks the leaf of the shaft door against unintended or unauthorized opening. The lock 78 is so arranged that it can rotate about an axle 72. The shaft door lock 78 is provided with a weight 74 so that the lock 78 automatically detents in the lock member as soon as the leaf of the shaft door has reached a closed setting. If the elevator car now approaches, by the car door, a floor, then two entraining blades (not shown) mounted at the leaf of the car door engage between two rollers 80 of a deflecting mechanism. The deflecting mechanism is so designed in the illustrated form of embodiment that one of the rollers 80 is fastened to the leaf of the shaft door and the second roller 80 is fastened directly to the shaft door lock 78. For unlocking the shaft door locking mechanism 70 the two entraining blades are spread apart, whereby these exert a force on the rollers 80 of the deflecting mechanism. Through this force the shaft door lock 78 executes a limited rotational movement about its rotational axle 72 in a counterclockwise sense. The weight 74 of the lock 78 is thereby raised and the locking relative to the lock member 71 is released. The shaft door can now be opened by the car door.

The shaft door lock and the shaft door lock securing means are preferably so constructed that in the case of emergency the shaft door can be unlocked from the floor side by a service engineer or by another operative. A special tool can, for example, be provided for this purpose.

According to the present invention there is provided a solution which is based on the fact that a method of closing the shaft doors by the car door or doors is combined with monitoring from the car which allows recognition whether locking of the shaft door lock has taken place. The present invention is based on the fact that the shaft doors are securely closed and locked after each actuation. Thus it is possible to dispense with the usual shaft door contacts and consequently also a large part of the safety circuit.

In the case of an elevator system according to the present invention the shaft doors can be opened only by the car when this is disposed at a corresponding floor behind the shaft doors. However, a shaft door can preferably also be opened by a service engineer when the engineer uses a special tool. The starting point can thus be that a shaft door is only open or can be opened when either an elevator car is located behind the corresponding shaft door or when an appropriately trained service engineer is present.

With the device according to the present invention it cannot be monitored whether a service engineer or another person has opened the shaft door by a special tool. In the case of previous systems a contact was opened by opening of the shaft door lock and the safety circuit interrupted. According to the present invention such a contact is no longer provided.

In a further form of embodiment of the present invention a sensor can be used which makes it possible to monitor whether a shaft door was opened by a special tool. A sensor of that kind is of lesser need, since opening by a special tool takes place only rarely. Moreover, such a sensor can be so constructed that it is less susceptible to distortion, displacement, wear, etc.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A shaft monitoring system for an elevator installation having an elevator car with a car door and being vertically movable in an elevator shaft, a shaft door by which access to the elevator shaft is closable and which has a door leaf, an automatically locking shaft door lock for locking the door leaf of the shaft door when the door leaf is in a closed setting, wherein the shaft door leaf can be unlocked by the elevator car, and an elevator control, the system comprising:

a contactless sensor means having a part arranged at the elevator car enabling recognition from the elevator car whether the shaft door lock and the door leaf of the shaft door are disposed in a correct locked setting thereof, said sensor means being connected with at least one of the elevator control and a separate safety monitoring system of the elevator installation.

2. The system according to claim 1 including a shaft door lock securing means for mechanically securing the shaft door lock in order to prevent opening of the shaft door, said shaft door lock securing means being one of mechanically and electromagnetically actuatable from the elevator car.

3. The system according to claim 1 wherein said contactless sensor means includes an active sensor part and a passive sensor part, said active sensor part being arranged at the elevator car, and said passive sensor part being arranged in the region of the shaft door lock to be monitored.

4. The system according to claim 3 wherein said active sensor part is arranged at the car door.

5. The system according to claim 3 wherein said active sensor part interacts with said passive sensor part as soon as the elevator car stops behind the shaft door to be monitored and the door leaf of the shaft door together with the shaft door lock to be monitored are disposed in the correct locked setting thereof.

6. The system according to claim 3 wherein said active sensor part transiently interacts with said passive sensor part when the elevator car moves past the shaft door to be monitored and the door leaf of the shaft door together with the shaft door lock to be monitored are disposed in the correct locked setting thereof.

7. An elevator installation comprising:

an elevator car vertically movable in an elevator shaft and having a car door;

at least one shaft door with at least one door leaf by which access to the elevator shaft is closable;

an automatically locking shaft door lock connected to said at least one shaft door for locking said at least one door leaf in a closed setting, said shaft door lock being unlocked by said elevator car;

an elevator control; and a contactless sensor means having a part arranged at said elevator car enabling recognition from said elevator car whether said shaft door lock and said at least one door leaf of said at least one shaft door are disposed in a correct locked setting thereof, said sensor means being connected to at least one of said elevator control and a separate safety monitoring system.

8. The elevator installation according to claim 7 wherein said contactless sensor means includes an active sensor part and a passive sensor part, said active sensor part being fastened to said elevator car, and said passive sensor part being fastened in a region of said shaft door lock to be monitored.

9. The elevator insulation according to claim 8 wherein said active sensor part is fastened to said car door.

10. The elevator installation according to claim 8 wherein said active sensor part and said passive sensor part interact as soon as said elevator car stops behind said at least one shaft door to be monitored, said at least one door leaf is disposed in a closed setting and said shaft door lock is in the correct locked setting.

11. A shaft door lock for an elevator installation, the elevator installation having an elevator car vertically movable in an elevator shaft, the elevator car having a car door, at least one shaft door with at least one door leaf by which access to the elevator shaft is closable, the elevator installation including an elevator control, comprising:

an automatically locking shaft door lock for locking the at least one door leaf of the at least one shaft door and being mechanically unlocked by the elevator car; and a passive sensor means contactlessly interacting with an active sensor part when the elevator car is disposed in a region of the at least one shaft door and the at least one shaft door and said shaft door lock are in a locked position.

12. The shaft door lock according to claim 11 including a shaft door lock securing means provided at said shaft door lock for mechanically securing said shaft door lock to prevent opening of the at least one shaft door, wherein said shaft door lock securing means is at least one of mechanically and electromagnetically actuatable from the elevator car.

13. The system according to claim 3 wherein said contactless sensor means is one of a light beam sensor detecting a reflection of an emitted light beam, a magnetic field sensor, an inductive sensor, a capacitive sensor or an ultrasound sensor.

14. The elevator installation according to claim 8 wherein said active sensor part transiently interacts with said passive sensor part when said elevator car moves past said shaft door to be monitored and the door leaf of the shaft door together with the shaft door lock to be monitored are disposed in the correct locked setting thereof.

* * * * *

UNITED STATES PATENT AND TRADEMARK OFFICE

CERTIFICATE OF CORRECTION

PATENT NO. : 7,350,625 B2
APPLICATION NO. : 10/947772
DATED : April 1, 2008
INVENTOR(S) : Romeo Deplazes et al.

It is certified that error appears in the above-identified patent and that said Letters Patent is hereby corrected as shown below:

Cover Page, item [30] should read as follows: This application is a CIP of
PCT/CH03/00182 03/21/2003

Cover Page, item [30] Priority Document should read as follows:
EUROPEAN PATENT OFFICE (EPO) 02405242.5 03/27/2002

Signed and Sealed this

Sixteenth Day of September, 2008

JON W. DUDAS
*Director of the United States Patent and Trademark Office*